US007654729B2

(12) United States Patent
Passoni

(10) Patent No.: US 7,654,729 B2
(45) Date of Patent: Feb. 2, 2010

(54) TEST-TUBE AGITATION DEVICE, COMPRISING MEANS FOR THE OPTICAL DETECTION OF A TEST-TUBE

(76) Inventor: Giovanni Passoni, Via Provinciale 34, Eupilio CO (IT) 22030

( * ) Notice: Subject to any disclaimer, the term of this patent is extended or adjusted under 35 U.S.C. 154(b) by 123 days.

(21) Appl. No.: 10/594,557

(22) PCT Filed: Mar. 24, 2005

(86) PCT No.: PCT/EP2005/003139

§ 371 (c)(1),
(2), (4) Date: Aug. 12, 2008

(87) PCT Pub. No.: WO2005/094977

PCT Pub. Date: Oct. 13, 2005

(65) Prior Publication Data

US 2008/0298162 A1 Dec. 4, 2008

(30) Foreign Application Priority Data

Mar. 31, 2004 (IT) ..... MI20040137 U

(51) Int. Cl.
*B01F 11/00* (2006.01)

(52) U.S. Cl. ..... 366/208; 366/111

(58) Field of Classification Search ..... 366/108–128, 366/208–219

See application file for complete search history.

(56) References Cited

U.S. PATENT DOCUMENTS 3,061,280 A * 10/1962 Kraft et al. ..... 366/110
3,159,384 A * 12/1964 Davis ..... 366/110
3,850,580 A * 11/1974 Moore et al. ..... 422/99
4,061,315 A * 12/1977 Eitzen et al. ..... 366/111
4,265,544 A 5/1981 Banno et al.
4,345,843 A * 8/1982 Berglund et al. ..... 366/219
4,372,683 A 2/1983 Sternberg
4,555,183 A * 11/1985 Thomas ..... 366/208
4,848,917 A * 7/1989 Benin et al. ..... 366/208
4,883,644 A * 11/1989 Perlman ..... 422/104
4,943,164 A * 7/1990 Ohishi et al. ..... 366/149
5,195,825 A * 3/1993 Ringrose ..... 366/213
5,632,956 A * 5/1997 Ghaed et al. ..... 422/52
5,795,061 A * 8/1998 Perlman ..... 366/130
5,813,759 A * 9/1998 Gebrian ..... 366/208

(Continued)

FOREIGN PATENT DOCUMENTS

EP 356883 A1 * 3/1990

(Continued)

OTHER PUBLICATIONS

Patent Abstracts of Japan, vol. 008, No. 038, Feb. 18, 1984 and JP58191955A (Sansutaa Giken KK), Nov. 9, 1983.

(Continued)

*Primary Examiner*—Charles E Cooley
(74) *Attorney, Agent, or Firm*—Jacobson Holman PLLC

(57) ABSTRACT

A powered test-tube agitation device includes a small plate having a rest for a test tube to be agitated and operated in agitation by a powered mechanism. The powered mechanism is started by optical detection of the entry of an object into a predetermined zone above the small plate. Advantageously the detector is a photoelectric infrared reflection detector.

12 Claims, 1 Drawing Sheet

U.S. PATENT DOCUMENTS

Figure 1:
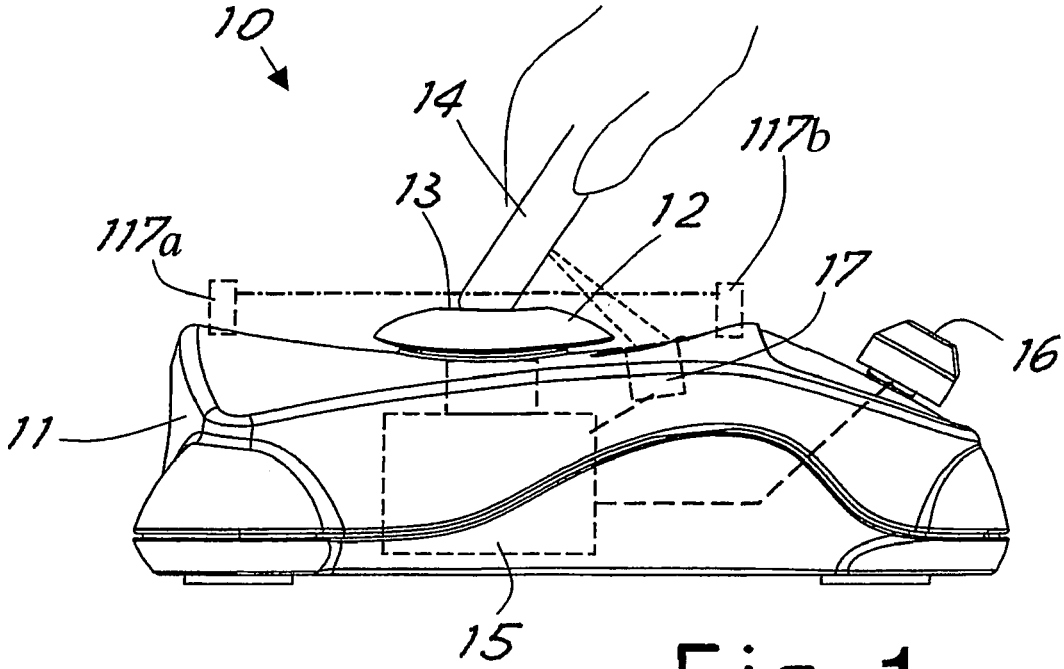

| | | | | |
|---|---|---|---|---|
| 7,296,924 | B2 * | 11/2007 | Czarnek | 366/208 |
| 7,575,363 | B2 * | 8/2009 | Ruser et al. | |
| 2002/0042141 | A1 | 4/2002 | Ricci et al. | |
| 2002/0118594 | A1 * | 8/2002 | Vellinger et al. | 366/116 |
| 2007/0125186 | A1 * | 6/2007 | Ruser et al. | 73/863.01 |
| 2007/0212265 | A1 * | 9/2007 | Ebers et al. | 422/99 |
| 2008/0298162 | A1 * | 12/2008 | Passoni | 366/111 |

FOREIGN PATENT DOCUMENTS

| | | | |
|---|---|---|---|
| EP | 0494846 | A2 | 7/1992 |
| GB | 2146252 | A * | 4/1985 |
| WO | WO 9831457 | A1 * | 7/1998 |
| WO | 99/59708 | * | 11/1999 |

OTHER PUBLICATIONS

Patent Abstracts of Japan, vol. 005, No. 165, Oct. 22, 1981 and JP56094244A (Chugai Pharmaceut Co Ltd), Jul. 30, 1981.

Patent Abstracts of Japan, vol. 016, No. 396, Aug. 21, 1992 and JP04130248A (Hitachi Ltd), May 1, 1992.

Patent Abstracts of Japan, vol. 2003, No. 12, Dec. 5, 2003 and JP2004109051A (Fuji Xerox Co Ltd), Apr. 8, 2004.

Patent Abstracts of Japan, vol. 2000, No. 26, Jul. 1, 2002 and JP2001249073A (Toto Ltd), Sep. 14, 2001.

Patent Abstracts of Japan, vol. 2000, No. 25, Apr. 12, 2001 and JP2001218755A (Shimadzu Corp), Aug. 14, 2001.

* cited by examiner

TEST-TUBE AGITATION DEVICE, COMPRISING MEANS FOR THE OPTICAL DETECTION OF A TEST-TUBE

This is a nationalization of PCT/EP2005/003139 filed 24 Mar. 2005 and published in English.

FIELD OF THE INVENTION

This invention relates to a test tube agitation device innovatively having contactless operation.

BACKGROUND OF THE INVENTION

Test tube agitation devices are known in the prior art and include a powered support on which the test tube to be agitated is set. To activate the agitation movement, either a manually activated switch or a microswitch arranged beneath the support and to be started by pressure of the test tube on the support is used. In the first case there is the disadvantage of having to use two hands, one to hold the test tube and the other to operate the switch, and the disadvantage of forgetting the started agitator after use. In the second case, one is required to manually exert a certain pressure on the test tube to start it with the possible risk of breaking test tubes of thinner glass and in any case with the need of a small physical effort that might in time bring a not negligible fatigue of the hand, especially in large analysis-laboratories where the same analyst performs a large number of agitations each day.

SUMMARY OF THE INVENTION

The general purpose of this invention is to remedy the above mentioned shortcomings by making available an innovative test-tube agitator that does not require manual activation not even as forced contact between test tube and device.

In view of this purpose it was sought to provide in accordance with this invention a powered test-tube agitation device including a small plate having a rest for a test tube to be agitated and started in agitation by a powered mechanism characterized in that the powered mechanism is operation by means of optical detection of the entry of an object into a predetermined zone above the small plate.

BRIEF DESCRIPTION ON THE PREFERRED EMBODIMENTS

Figure 2:
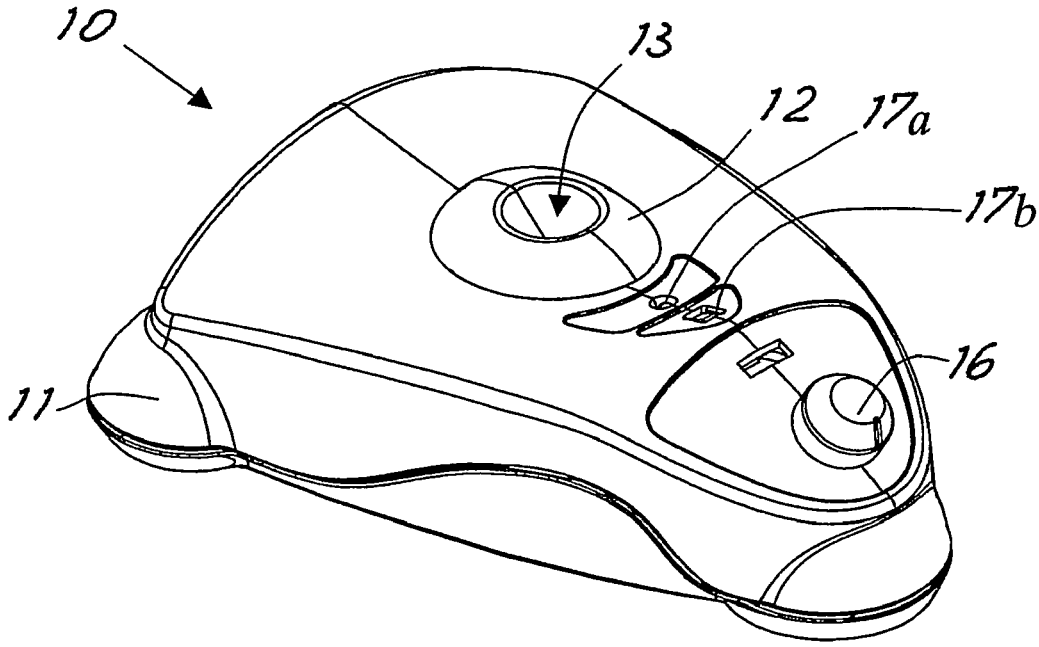

To clarify the explanation of the innovative principles of this invention and its advantages compared with the prior art there is described, below with the aid of the annexed drawings a possible embodiment thereof by way of non-limiting example applying said principles. In the drawings:

FIG. 1 shows a side elevation view of an agitator in accordance with this invention, and FIG. 2 shows a diagrammatic perspective view of the agitator of FIG. 1.

DETAILED DESCRIPTION OF THE DRAWINGS

With reference to the figures, FIG. 1 shows diagrammatically an agitator device designated as a whole by reference number 10 and realized in accordance with this invention. The device includes a housing 11 on the top of which there is a plate 12 having a seat or recess 13 for receiving the bottom of a test tube 14 to be agitated. The plate 12 can be the replaceable type to be adaptable to different requirements and forms of the container to be agitated. Naturally, with the generic term 'test tube' is intended here any container usually employed or employable with agitators of the generic type to which belongs the device described here such as for example micro-test tubes, cuvettes, baking utensils, matrasses, flasks, Erlenmeyer flasks et cetera.

The plate 12 is put in agitation by a purposeful mechanism 15 within the device with suitable frequency and amplitude of the vibrations and possibly in a manner adjustable by means of an appropriate control 16. The agitator mechanism (generally the electromechanical type) is known and not further described or shown since it is readily imaginable. to those skilled in the art.

In accordance with this invention the device 10 includes optical detection means of the presence of the test tube above the plate to start the agitation mechanism 15 automatically with no need for action on external manual controls.

Advantageously in the preferred embodiment there is a photoelectric reflection system advantageously of the infrared type and designated as a whole by reference number 17. As may be seen well in FIG. 2, the detection device 17 includes an infrared emitter 17*a* (for example, infrared LED) and an infrared receiver 17*b* (for example, a phototransistor) arranged on the same side of the plate and sloped appropriately to 'illuminate' the zone over the plate 12 so that an object inserted in that zone would reflect towards the receiver the light emitted by the emitter. When the receiver receives the reflected signal it emits a corresponding signal for activation of the powered agitation mechanism 15. When the object that caused the reflection is removed, the agitation mechanism is stopped. As may be seen in the figures, front positioning of the sensors was found particularly advantageous so that the beam is turned backward as this minimizes false detections due to the passage of the hand or a person in front of the apparatus.

Even though a reflecting optical system was found particularly advantageous, a photoelectric barrier system can be used in accordance with the principles of this invention. This is shown diagrammatically in broken lines in FIG. 1 with a transmitter 117*a* and a receiver 117*b* aligned on two opposite sides of the plate so that a detection beam passes from one to the other through the zone above the plate.

It is now clear that the preset purposes have been achieved by making available a device that does not require any physical contact for its operation as it is sufficient to bring the test tube closer to the agitation plate without any effort by the user. This makes laboratory use easier. Furthermore, contact of the hand with the controls causing undesired transfer of substances harmful for users or for analyses is avoided.

In accordance with the principles of this invention it was also found advantageous that the detection device 17 activate the mechanism 15 with a small delay (advantageously between 10 ms and 1 sec and preferably 100 ms) to allow the test tube to reach the seat 13 and rest there before the vibrations begin. This avoids jolts and slipping of the test tube. As another particularly advantageous characteristic the agitation system can be started gently with a programmed rising ramp of amplitude and/or frequency of the oscillations.

Thanks to the fact that no physical contact or pressure of the test tube on the plate is necessary to start agitation, the designer can change the delay time and starting ramp at will to obtain predetermined and preferred first contact conditions between the test tube and the plate; for example a light starting movement of the plate before contact to bring the bottom of the test tube to the center of the seat 13 before contact.

Naturally the above description of an embodiment applying the innovative principles of this invention is given by way of non-limiting example of said principles within the scope of the exclusive right claimed here. For example, the form and proportions of the various parts can change depending on specific requirements and preferences. The device can also include additional known systems and accessories such as connections to other equipment and laboratory data networks. Advantageously, the device can also include a main turning-off switch (not shown) to avoid inappropriate starting when not required.

What is claimed is:

1. A powered test-tube agitation device comprising an agitation plate having a rest for a bottom of a test tube to be agitated to rest and a powered mechanism operatively connected to the agitation plate to put the plate in agitation, an optical detection means for optical detection in a predetermined zone above the plate, the optical detection means being operatively connected to the powered mechanism to activate operation thereof when an object is detected entering said predetermined zone above the agitation plate.

2. The device in accordance with claim 1, wherein the optical detection means includes a photoelectric reflection detection device.

3. The device in accordance with claim 2, wherein the photoelectric reflection detection device includes an infrared emitter and an infrared receiver arranged close to the side of said plate.

4. The device in accordance with claim 2, wherein the photoelectric reflection detection device is arranged in front of the rest and turned towards the rear of the device.

5. The device in accordance with claim 1, wherein the optical detection means includes a barrier photoelectric detection device.

6. The device in accordance with claim 1, wherein the optical detection means activates the powered mechanism with a predetermined delay.

7. The device in accordance with claim 6, characterized in that the delay is between 10 ms and 1 s and preferably 100 ms.

8. The device in accordance with claim 1, wherein the powered mechanism is started with a predetermined ramp of increase in the frequency and/or amplitude of the plate agitation movement.

9. A powered test-tube agitation device comprising a plate having a rest for a test tube to be agitated and a powered mechanism operating the plate in agitation, and an optical detection means for optical detection of the entry of an object into a predetermined zone above the plate, the optical detection means being operatively connected to the powered mechanism to activate operation thereof, the optical detection means activating the powered mechanism with a predetermined delay.

10. The device in accordance with claim 9, wherein the delay is between 10 ms and 1 s and preferably 100 ms.

11. A powered test-tube agitation device comprising a plate having a rest for a test tube to be agitated and a powered mechanism operating the plate in agitation, and an optical detection means for optical detection of the entry of an object into a predetermined zone above the plate, the optical detection means being operatively connected to the powered mechanism to activate operation thereof, the powered mechanism being started with a predetermined ramp of increase in a frequency and/or an amplitude of the plate agitation movement.

12. A powered test-tube agitation device comprising a plate having a rest for a test tube to be agitated and a powered mechanism operating the plate in agitation, an optical detection means for optical detection of the entry of an object into a predetermined zone above the plate, the optical detection means being operatively connected to the powered mechanism to activate operation thereof, the optical detection means including a photoelectric reflection detection device, the photoelectric reflection detection device being arranged in front of the rest and turned towards a rear of the device.

* * * * *